US010125510B2

(12) United States Patent
Dogan

(10) Patent No.: US 10,125,510 B2
(45) Date of Patent: Nov. 13, 2018

(54) EARTHQUAKE ISOLATOR

(71) Applicant: Adnan Dogan, Istanbul (TR)

(72) Inventor: Adnan Dogan, Istanbul (TR)

( * ) Notice: Subject to any disclaimer, the term of this patent is extended or adjusted under 35 U.S.C. 154(b) by 0 days.

(21) Appl. No.: 15/509,110

(22) PCT Filed: Jul. 6, 2015

(86) PCT No.: PCT/TR2015/000273
§ 371 (c)(1),
(2) Date: Mar. 6, 2017

(87) PCT Pub. No.: WO2016/007104
PCT Pub. Date: Jan. 14, 2016

(65) Prior Publication Data

US 2017/0241151 A1 Aug. 24, 2017

(30) Foreign Application Priority Data

Jul. 6, 2014 (TR) ..... 2014-07892

(51) Int. Cl.
*E04H 9/02* (2006.01)
*E04B 1/98* (2006.01)

(52) U.S. Cl.
CPC ..... *E04H 9/023* (2013.01); *E04B 1/985* (2013.01); *E04H 9/027* (2013.01)

(58) Field of Classification Search
CPC ..... E04H 9/023; E04H 9/027; E04B 1/985
USPC ..... 52/167.5, 167.1, 167.4
See application file for complete search history.

(56) References Cited

U.S. PATENT DOCUMENTS 1,651,411 A * 12/1927 Porter ..... E04H 9/023 52/167.6
2,014,643 A * 9/1935 Bakker ..... E04H 9/023 384/49
2,055,000 A * 9/1936 Bacigalupo ..... E04H 9/023 52/167.6
3,730,463 A * 5/1973 Richard ..... F16F 1/3732 248/580
3,771,270 A * 11/1973 Byers ..... E04H 9/023 248/638
4,328,648 A * 5/1982 Kalpins ..... E02D 27/34 248/638
4,330,103 A * 5/1982 Thuries ..... F16F 15/02 248/548
4,517,778 A * 5/1985 Nicolai ..... E04H 9/023 384/49
4,617,769 A * 10/1986 Fyfe ..... E01D 19/04 52/167.8
4,881,350 A * 11/1989 Wu ..... E04H 9/021 248/580
5,261,200 A * 11/1993 Sasaki ..... E04B 1/36 248/638

(Continued)

*Primary Examiner* — Basil S Katcheves
*Assistant Examiner* — Joshua K Ihezie
(74) *Attorney, Agent, or Firm* — Gokalp Bayramoglu

(57) ABSTRACT

Invention; is related to isolators eliminating circular forces caused by earthquake forces acting on the building. It is placed between foundation of structures manufactured by steel construction, concrete, prefabricated structure or other methods and structure and which reduces/terminates impact of earthquakes on structures. Thus, damage to be given by earthquake to carrying elements of building is eliminated.

7 Claims, 11 Drawing Sheets

(56) References Cited

U.S. PATENT DOCUMENTS

| | | | | |
|---|---|---|---|---|
| 5,538,373 | A * | 7/1996 | Kirkham | B23Q 1/5462 248/562 |
| 6,123,313 | A * | 9/2000 | Otsuka | E04H 9/023 248/580 |
| 8,393,119 | B2 * | 3/2013 | Alsaif | E04H 9/023 52/167.6 |
| 2002/0166296 | A1 * | 11/2002 | Kim | E04H 9/023 52/167.5 |
| 2007/0069103 | A1 * | 3/2007 | Ferrari | E04H 9/021 248/544 |
| 2008/0098670 | A1 * | 5/2008 | Hsu | E04H 9/021 52/167.1 |
| 2009/0013619 | A1 * | 1/2009 | Marroquin | E04H 9/023 52/167.6 |
| 2011/0176919 | A1 * | 7/2011 | Coffey | F03D 3/005 416/124 |
| 2013/0326969 | A1 * | 12/2013 | Kienholz | F16F 7/1011 52/167.2 |

* cited by examiner

EARTHQUAKE ISOLATOR

TECHNICAL FIELD

Invention is about an isolator placed between foundation of steel structures, concrete structures, prefabricated structure or other methods and structure to reduce/terminate impact of earthquakes on the structures.

BACKGROUND

The earthquake is defined as shaking of crust of earth by spreading of vibrations in the form of wave due to breaks in the earth's crust. Earthquake, a natural phenomenon indicates that earth can also move and all the buildings on it can be harmed and people could die.

The science engaged with how earthquakes occur, spreading of earthquake wave on the earth crust, measuring instruments and methods, evaluation and registrations and readings and other issues related to the earthquake is called "SEISMOLOGY"

There is an earth model supported by data obtained from geological and geophysical studies about the internal structure of the earth. According to this model there is lithosphere at the Earth's outer part of 70-100 km thickness. Continents and oceans are located in this lithosphere. There is mantle between the core and lithosphere with thickness of 2,900 km. The bottom of the mantle is considered to consist of a mixture of nickel-iron core. It is known that temperature increases from surface to deeper. It is estimated to be average 5000-6000° C. It is concluded that core has a liquid structure depending on the fact that transverse seismic waves don't spread towards core of earth.

In general mantle is solid at surface, towards core there are local liquid layers.

There is soft upper mantle under earth crust which is called asthenosphere.

The forces formed here, especially the stone crust due to convection currents, are fragmented and divided into many "Plates". Convection currents formed on the upper mantle are connected to temperatures caused by radioactivity.

As convection currents increase, it cause stress on stone rollers and then leads to the formation of plates by breaking weak zones. Already there are ten big plates and many small plates. These plates float on asthenosphere with continents like a boat and move relative to each other with a speed not perceived by people.

In places where the convection currents rise, the pates move away from each other and form the oceanic ridge in the hot magma coming out of them. At locations where plates come into contact with each other friction and compression occurs. One of the friction plates sink into the mantle below and constitute subduction zones by melting. These sequential events caused by convection currents continue under crust of earth.

Boundaries of these plates which rub each other, compress each other, climb each other or fall under each other appear as earthquake in the world. Vast majority of earthquakes occurring in the world take place on narrow zones at plate boundaries where they force each other.

There is a frictional force between two plates pushing each other or entering under each other that prevents motion. For the motion of such a plate this friction force must be overcome.

When the friction force between one pushed plate and another plate is exceeded a movement takes place. This action takes place in a very short time and has a form of shock. Finally, earthquake waves which can spread very far (shock) occur. These waves shake the environment as they pass through and energy decreases as waves get farther from the direction of earthquake. Meanwhile land fractures occur on earth which is called as fault line and sometimes visible and extend for miles. These fractures are sometimes not observable on earth and they might be hidden by the surface layers. Sometimes, an old fault line formed due to an old earthquake but covered in time can move again.

In this way formation of the earthquake was described under the theory of "elastic rebound theory" by American Reid in 1911 and has been proven in laboratory with experiments.

According to this theory, energy preserved by unit deformation accumulation elastically depending on time at any point reaches a critical value, it defeats the friction that exists along the fault line and cause motion of fault lines on both sides of rock forms relative to each other. This event is the sudden displacement movement.

This sudden displacement occurs due to discharge of unit deformation energy accumulated at a specific point, discharge in other words with the conversion to mechanical energy, and as a result due to breaking and tearing of earth layers.

In fact, it is impossible for rocks to break without the accumulation of a pre-displacement unit. These unit displacement movements are created by convection currents that occur in the upper mantle, and rocks may show strength until a certain deformation and then get fractured. These breakage results in earthquakes. After such cases a part of stress and energy accumulated away from the rocks are removed.

Mostly on faults occurring during this earthquake, elastic re-bounds (stroke) are formed on both sides of the faults in the opposite direction.

Faults are usually named according to the direction of movement. Faults with more horizontal movement results in "strike-slip faults." In addition, two separate blocks that form the fault may have movement relative to each other from left or right which is an example of the right or left lateral strike-slip faults.

Faults occurring due to vertical movement are called "dip-slip faults". Most of the faults may have both horizontal and vertical movements.

Earthquakes are natural events, each hosting its own unique and many unpredictable variables. Considering the many possibilities, earthquake should be treated according to its structure. Studies for the calculation of the behavior of your structure and the strength during major earthquake is the ideal for mankind. For the sake of this many laws, regulations, calculations and specifications were made and continues.

In general, in all the calculations and studies made in the world, only effects of horizontal direction of earthquakes are taken into account. Engineers calculate earthquake loads to effect structure from both sides similarly and distribute these loads to structure floors at specific rates. In buildings constructed by considering only horizontal forces ductility of nonlinear beams and curtains cannot be calculated correctly. This situation mostly results in bending on collapse of these structures. Probability of survival of people within this type of structure is very less.

Today, rubber isolators and pendulum isolators are used to protect structure against earthquakes. Rubber isolators are formed with rounded rubbers placed between steel plates. Here, it is believed that earthquake is isolated due to rubber horizontal shift and horizontal displacement of each of 15-20 plates. Rubber isolators should be placed between the columns and beams in single-story structures with or between foundation and structure (viaduct, bridge, and hangar). Rubber isolators disconnect link between foundation and structure. It is not possible for structure to transfer momentum to foundation. Horizontal forces are also suspected to be transferred to foundation. If rubber isolators make horizontal displacement between each plate, it allows vertical displacement as well. In this case because building will try to be overthrown during earthquake due to the centrifugal force, when building is disconnected from foundation building will overturn. This system cannot be applied in the multi-story buildings. The risks posed to rubber during the fire, should be taken into account.

Pendulum isolators consist of two parts. There is no connection with the basic structure as in the rubber isolator. It cannot handle the momentum of the building and because adherence will increase due to weight of building, shift of the pendulum isolators will be weaken. This situation is a barrier to achieve the desired result. It is not suitable for multi-story buildings. It can cause the collapse of a structure and the earthquake can heavily damage the structure.

SUMMARY

Invention is related to isolators eliminating circular forces caused by earthquake forces acting on the building. It is placed between foundation of steel structures, concrete structures, prefabricated structure or other methods and structure to reduce/terminate impact of earthquakes on structures. Thus, damage caused by earthquake to building is eliminated.

MEANINGS OF PART NUMBERS SPECIFIED IN FIGURES ARE AS FOLLOWS

Figure 1:
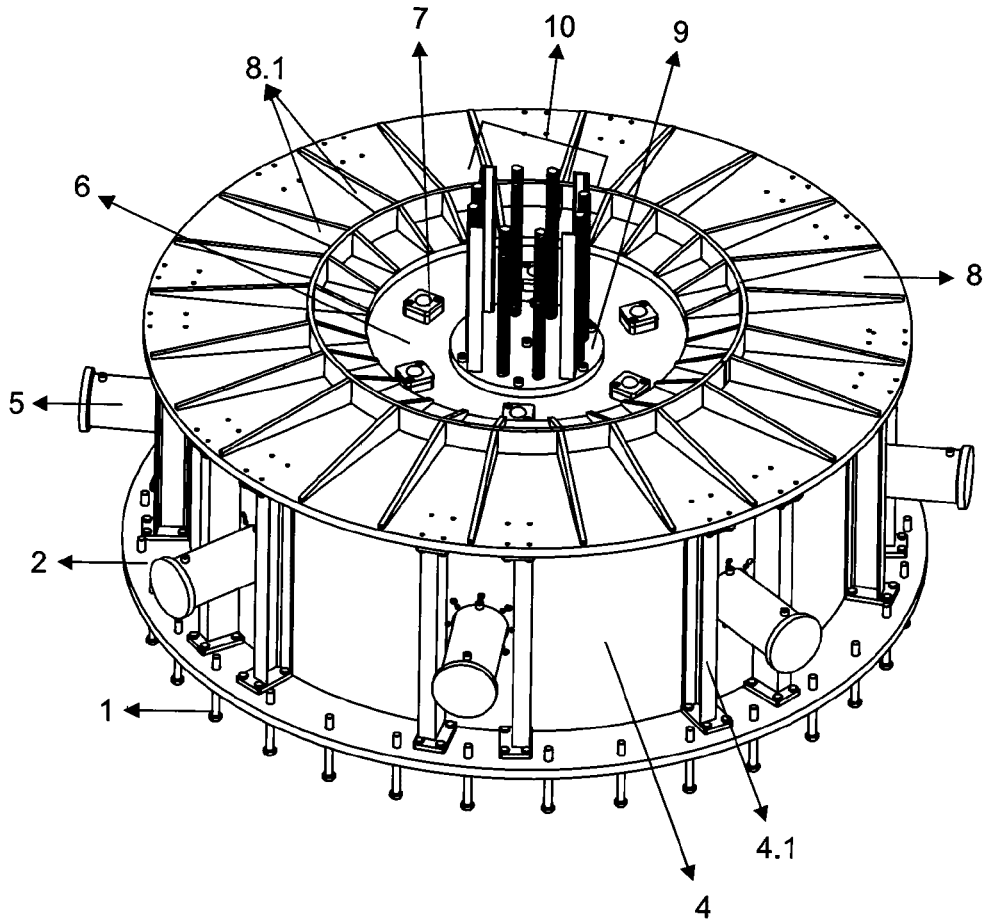
FIG. 1. Assembled Perspective view
FIG. 2. Exploded View Perspective
FIG. 3.A Detail View
FIG. 4. Mounted Side View
FIG. 5. A-A Section View
FIG. 6. B Detail View
FIG. 7. C Detail View
FIG. 8 B-B Section View
FIG. 9. D Detail View
FIG. 10. Assembled Top View
FIG. 11.E Detail View
FIG. 12. F Detail View
FIG. 13. Side View of the heel piece
FIG. 14. Top View of the heel piece
FIG. 15. Exploded Perspective view of the heel part
FIG. 16. G Detail View
FIG. 17. Bottom Plate and Side View of Old Ball Group
FIG. 18. H Detail View
FIG. 19. Top View Bottom Plate and Lower Ball Group
FIG. 20. Bottom Plate and Lower Ball Group exploded perspective view
FIG. 21. 1 Detail View
FIG. 22. Overview of Centering Piston Perspective
Figure 2:
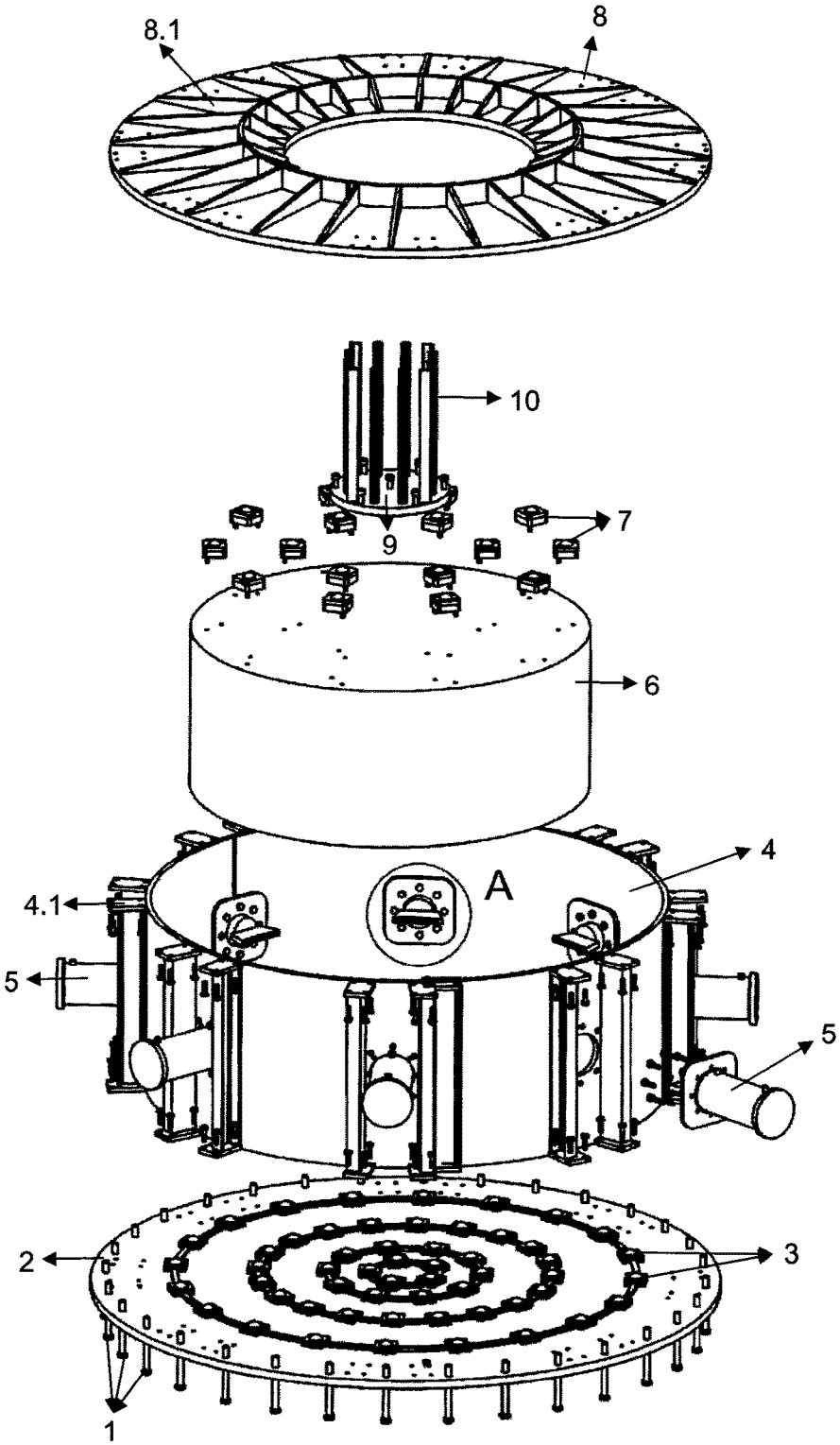
Figure 3:
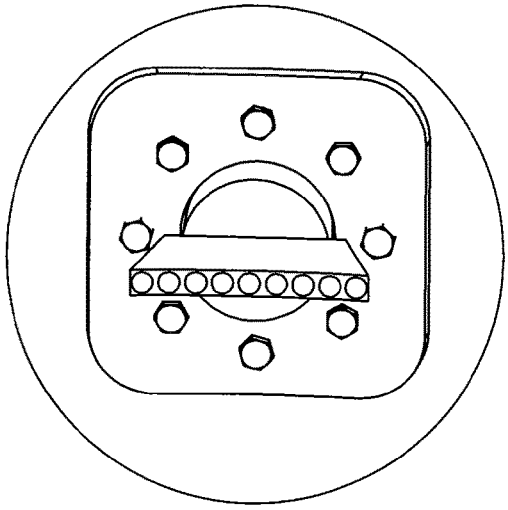
Figure 4:
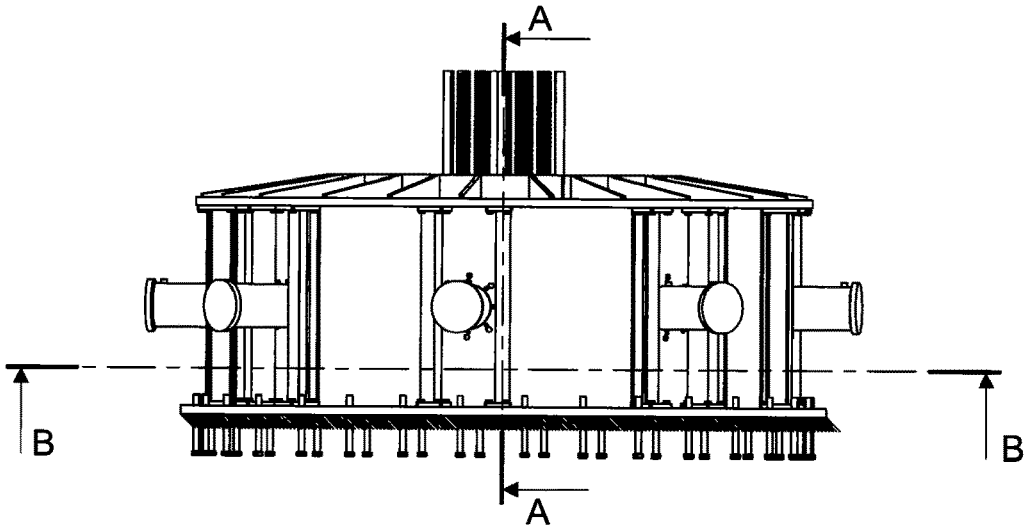
Figure 5:
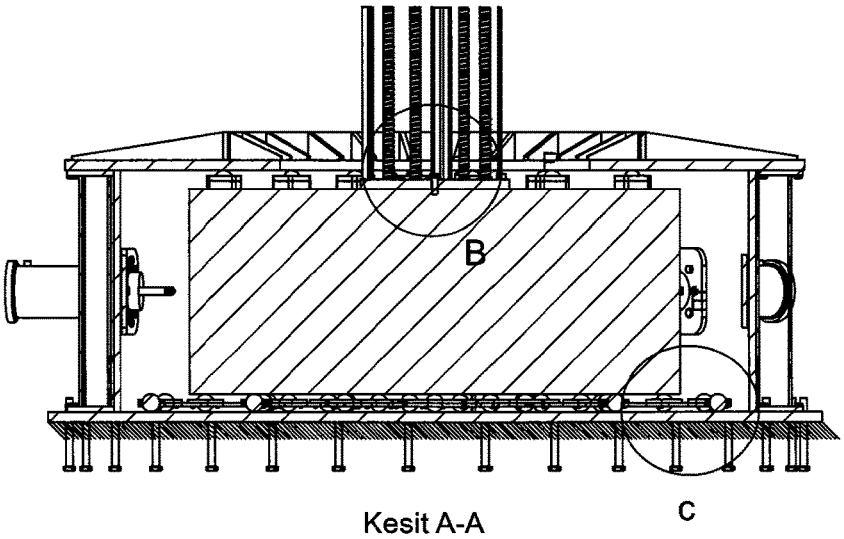
Figure 6:
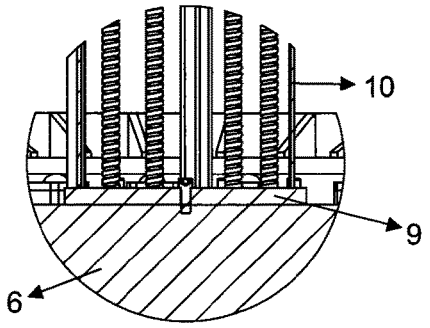
Figure 7:
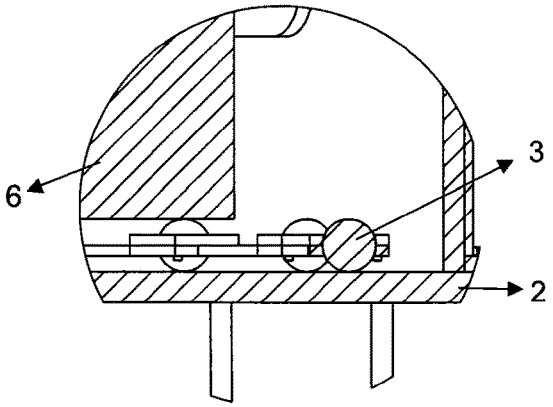
Figure 8:
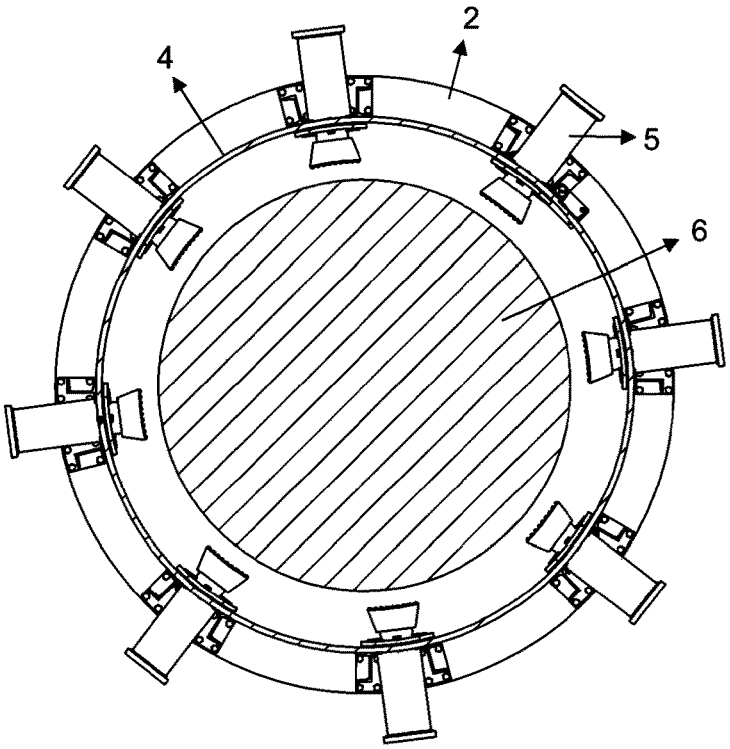
Figure 9:
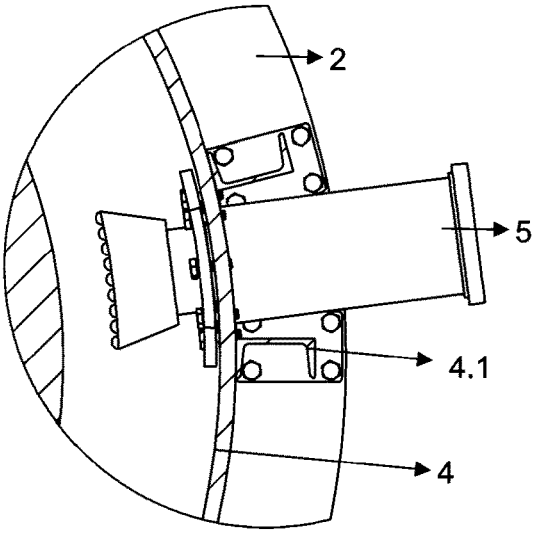
Figure 10:
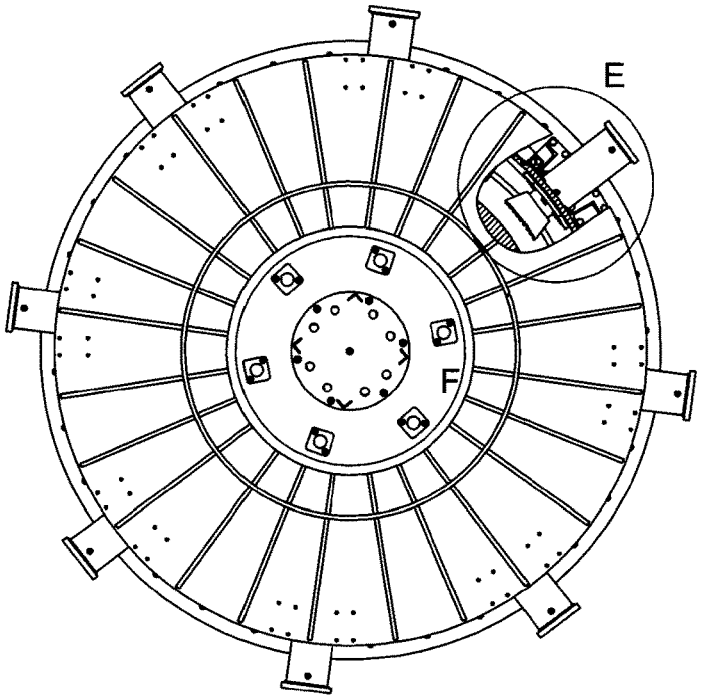
Figure 11:
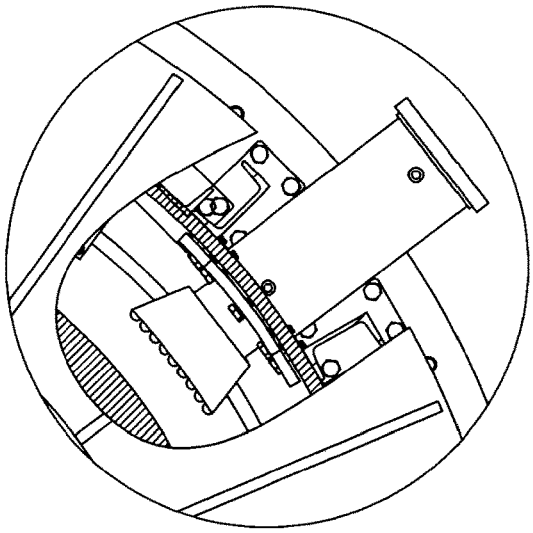
Figure 12:
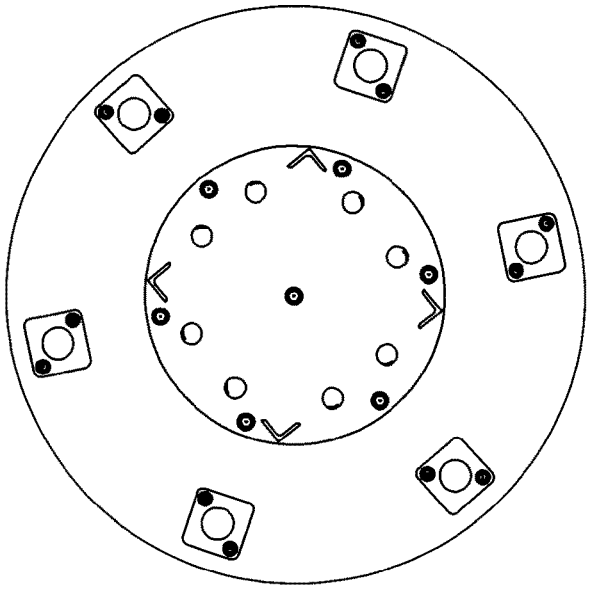
Figure 13:
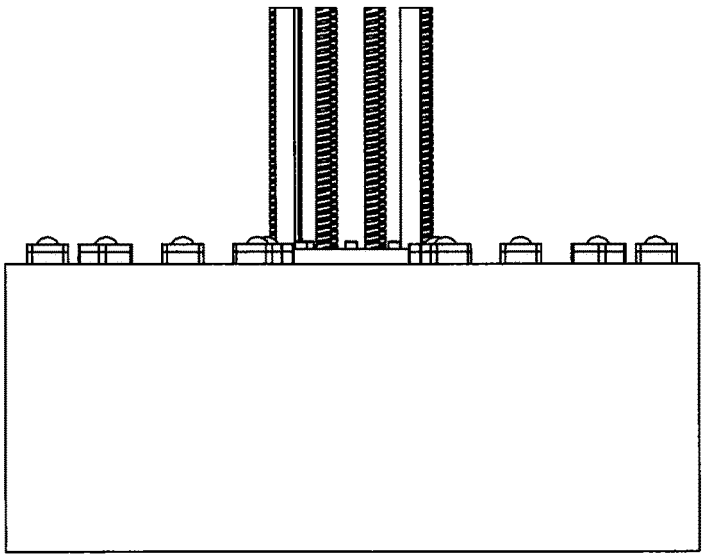
Figure 14:
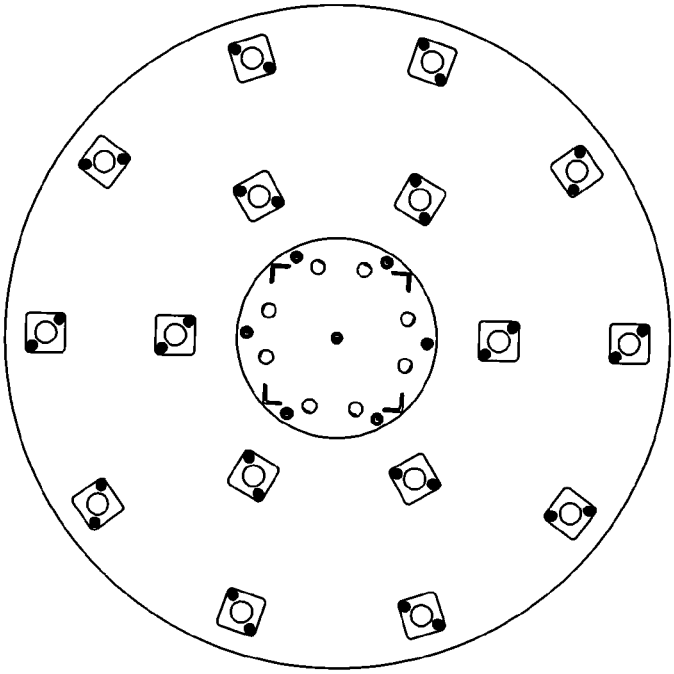
Figure 15:
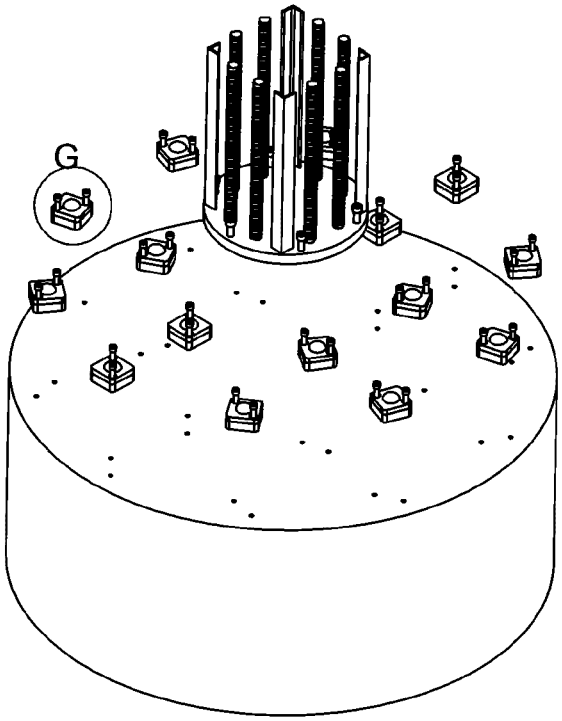
Figure 16:
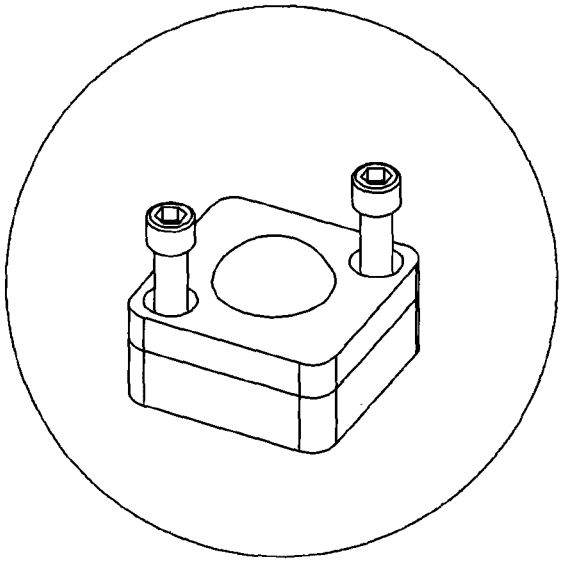
Figure 17:
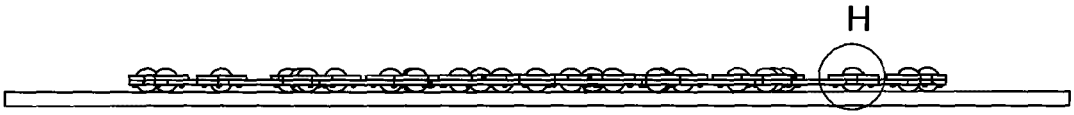
Figure 18:
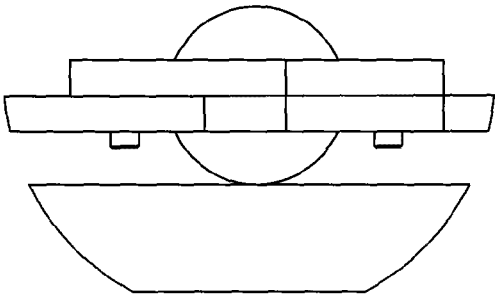
Figure 19:
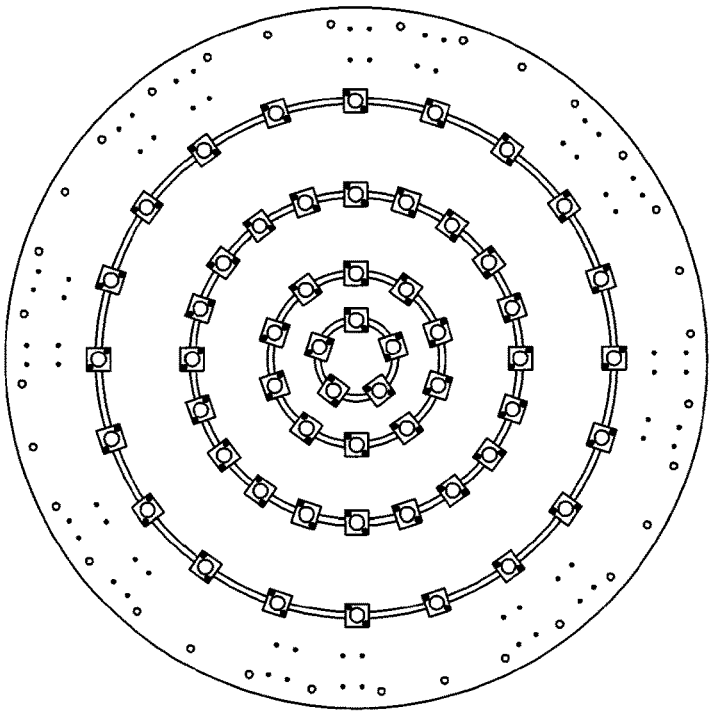
Figure 20:
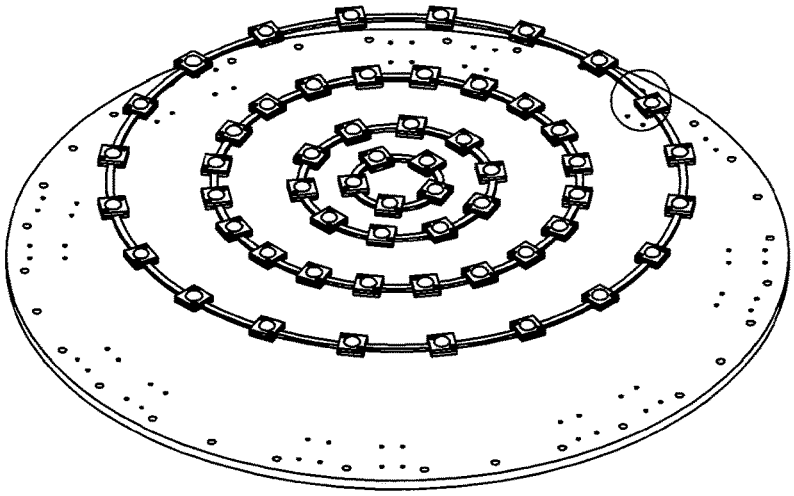
Figure 21:
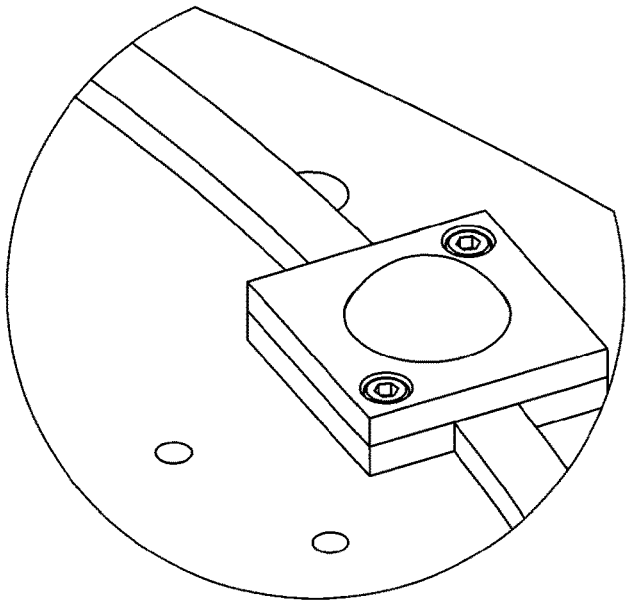
Figure 22:
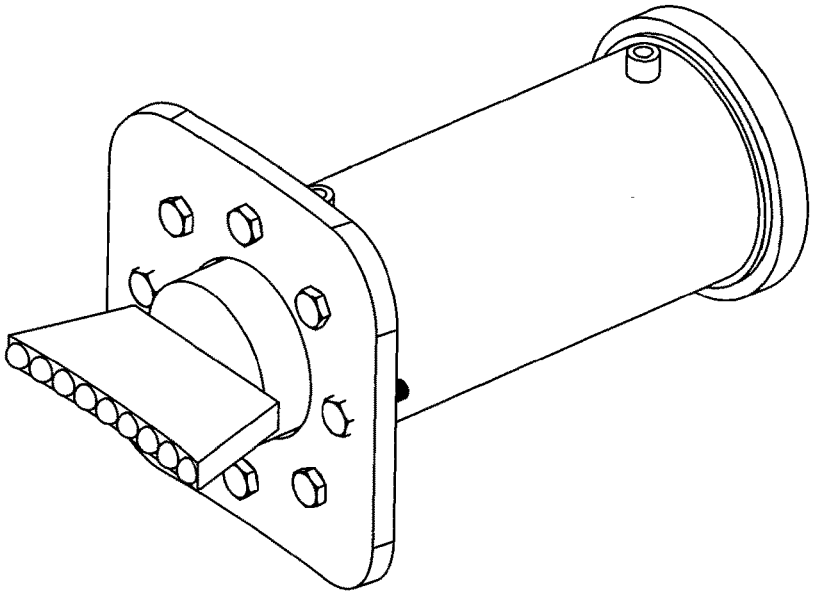

1. Anchor rod
2. Lower Chassis
3. Lower Moving Ball Group
4. Body
4.1. Reinforcing Pillar
5. Centering Piston
6. Heel
7. Top Ball Group
8. Top chassis
8.1. Flag
9. Link plate
10. Access sprouts

DETAILED DESCRIPTION

Invention consists of anchor rod (1), lower chassis (2), lower moving ball group (3), body (4) centering piston (5), heel (6), upper ball group (7), upper chassis (8), connection plate (9) connection sprouts (10). Body (4), comprises reinforcing pillar (4.1). The upper chassis (8) contains flag (8.1) on it.

Holes are drilled into sections on body (4) where centering piston (5) is to be assembled. At least one reinforcing pillar (4.1) is mounted on edges of the hole. Then centering pistons (5) are placed on body (4) and secured. Centering pistons (5) should be secured to be aligned with the vertical axis of the body (4).

Body mounting structure is placed on lower chassis (2) and mounted together rigidly. Then lower moving ball group (3) meets the mechanical load of building placed on lower chassis (2) according to the force distribution. Because lower moving ball group (3) is a free moving carrying element, it is deposited in a slot. Lower moving ball group (3) moves freely between heel (6) and lower chassis (2).

Connection plate (9) is mounted on heel (6) where upper ball group (7) and connection sprouts (10) are secured. The prepared assembly set is mounted on lower moving ball group (3) to be coaxial with the body (4). Then the upper chassis (8) is connected to body (4) in same axis with lower chassis (2) with reinforcement struts (4.1) rigidly. To increase the strength of upper chassis (8), flags (8.1) are placed on it in a circular axis.

At least one seismic isolator facing the bottom of each carrier column will be secured on the foundation of the structure according to the ground properties with anchor rods (1). Structure is connected to seismic isolator with connection sprouts (10). In required circumstances, perennial foundation will be made on connection sprouts (10) of seismic isolators placed on foundation with specified intervals and structure will be built on this perennial foundation.

The devastating effects, that are created by horizontal movements during earthquakes, steins from circular form force. So, structure faces centrifugal force. This centrifugal force constitutes the devastating effects on structure. To minimize or eliminate this impact, the invention provides effective protection.

The invention is used to isolate the resonance faced by structures during an earthquake. When earthquake-induced force starts to impact a structure built on seismic isolator; lower chassis (2), body (4) and the upper chassis (8) mounted to be anchored to the foundation, starts to move together with the foundation. Heel (6), connection plate (9) and the connection sprout (10) tries to maintain its current position together with building. The system to provide this effect is upper ball group (7) and is in contact with upper chassis (8) and secured to heel (6) (freely movable within housing) and lower moving ball group (3) located under the heel (6). Upper ball group (7) at the same time transfers momentum coming from the structure to the body (4) with heel (6). Momentum transmitted to body (4) is then transferred to foundation. Due to free movement of lower moving ball group (3) within the housing friction stemming from the weight of the structure during earthquake is zero. Thus, horizontal deflections coming to foundation are eliminated without being transferred to structure. After the earthquake ends, heel (6) may be in a position eccentric from the center of seismic isolators. Centering pistons (5) located on the body (4) provides the heel (6) and structure to take original position before the earthquake. Centering piston (5) strokes are equal and are located at equal intervals. With equal force and speed coming to stroke mills of centering pistons (5), heel (6) is brought to center of earthquake isolators by means of centering pistons (5). Thanks to a free moving ball on tip of the cylinder, deformation and friction are minimized.

Because heel (6) will move freely within body (4) during earthquake, diameter difference between body (4) and heel (6) is calculated with safety criteria to meet displacement of earthquake in respect to the ground characteristics where the foundation will be established.

The invention claimed is:

1. A seismic isolator, comprising:

an anchor rod;

a lower chassis;

a lower moving ball group;

a body with a plurality of holes and a plurality of reinforcing pillars such that at least one of the plurality of reinforcing pillars is mounted around at least one of the plurality of holes;

a plurality of centering pistons;

a heel placed above the lower moving ball group;

an upper ball group;

an upper chassis;

a connection plate; and a plurality of connection sprouts;

wherein the connection plate is mounted on the heel to secure the upper ball group and connection sprouts to obtain an assembly set; and wherein the assembly set is mounted on the body and placed on the lower chassis, the lower moving ball group moves freely between the heel and the lower chassis to meet the mechanical load of a building placed on the lower chassis, the seismic isolator is secured to the ground with the anchor rod.

2. The seismic isolator of claim 1, wherein the body comprises a plurality of reinforcing pillars.

3. The seismic isolator of claim 1, wherein the upper chassis comprises a plurality of flags.

4. The seismic isolator of claim 1, wherein the heel is movable.

5. The seismic isolator of claim 1, wherein the centering pistons brings the heel to an original position.

6. The seismic isolator of claim 1, wherein the heel is connected to the upper ball group, the connection plate and the connection sprouts.

7. The seismic isolator of claim 1, wherein the upper ball group is connected to the heel.

* * * * *